US007366440B2

(12) United States Patent
Horikawa

(10) Patent No.: US 7,366,440 B2
(45) Date of Patent: Apr. 29, 2008

(54) PROCESS CARTRIDGE FEEDING DEVELOPER FROM FIRST TO SECOND REMOVED DEVELOPER ACCOMMODATING PORTIONS AND IMAGE FORMING APPARATUS TO WHICH THE CARTRIDGE IS MOUNTABLE

(75) Inventor: Tadashi Horikawa, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 262 days.

(21) Appl. No.: 11/094,371

(22) Filed: Mar. 31, 2005

(65) Prior Publication Data

US 2006/0127128 A1 Jun. 15, 2006

(30) Foreign Application Priority Data

Dec. 13, 2004 (JP) ..... 2004-360033
Mar. 15, 2005 (JP) ..... 2005-073115

(51) Int. Cl.
*G03G 21/16* (2006.01)

(52) U.S. Cl. ..... 399/111; 399/119; 399/120; 399/358; 399/360

(58) Field of Classification Search ..... 399/111, 399/113, 119, 120, 358, 359, 360
See application file for complete search history.

(56) References Cited

U.S. PATENT DOCUMENTS 4,768,055 A * 8/1988 Takamatsu et al. ..... 399/111
5,615,001 A 3/1997 Kawashima et al. ..... 399/226
6,385,416 B1 5/2002 Horikawa et al. ..... 399/111
6,553,189 B2 4/2003 Miyamoto et al. ..... 399/27
6,681,088 B2 1/2004 Kanno et al. ..... 399/111
2002/0001476 A1* 1/2002 Nagamine et al.

FOREIGN PATENT DOCUMENTS

JP 5-107918 A 4/1993
JP 8-15935 A 1/1996
JP 2001-83863 A 3/2001
JP 2004-21134 A 1/2004
JP 2004-101592 A 4/2004

* cited by examiner

*Primary Examiner*—David M. Gray
*Assistant Examiner*—Laura K Roth
(74) *Attorney, Agent, or Firm*—Fitzpatrick, Cella, Harper & Scinto

(57) ABSTRACT

An electrophotographic image forming apparatus to which a process cartridge and a developer cartridge are independently attachable. The cartridge includes an electrophotographic photosensitive drum, a developing roller, a first developer accommodating portion for accommodating a developer used by the roller, a developer receiving port for receiving the developer from the developer cartridge into the first developer accommodating portion when the process cartridge is mounted to the apparatus, a cleaning member for removing the developer from the drum, first and second removed developer accommodating portions for accommodating the developer removed from the drum by the cleaning member, and a developer feeder device for feeding the developer from the first to the second portions. When the process and developer cartridges are mounted to each other, the developer cartridge is disposed above the first developer accommodating portion and at a side of the second removed developer accommodating portion.

7 Claims, 18 Drawing Sheets

PROCESS CARTRIDGE FEEDING DEVELOPER FROM FIRST TO SECOND REMOVED DEVELOPER ACCOMMODATING PORTIONS AND IMAGE FORMING APPARATUS TO WHICH THE CARTRIDGE IS MOUNTABLE

FIELD OF THE INVENTION AND RELATED ART

The present invention relates to a process cartridge detachably mountable to a main assembly of an electrophotographic image forming apparatus and the electrophotographic image forming apparatus.

Here, the electrophotographic image forming apparatus is an apparatus for forming an image on a recording material, such as a plain paper sheet or an OHP sheet through an electrophotographic image-formation-type process. Examples of the electrophotographic image forming apparatus include an electrophotographic copying machine, an electrophotographic printer (a laser beam printer, an LED printer or the like), a facsimile machine and a word processor.

The process cartridge is a cartridge which contains developing means, cleaning means and an electrophotographic photosensitive member as a unit, which is detachably mountable to the main assembly of the electrophotographic image forming apparatus.

An electrophotographic image forming apparatus of a process cartridge type is known in which an electrophotographic photosensitive member and process means actable on the electrophotographic photosensitive member are formed into a unit cartridge, which is detachably mountable to the main assembly of the electrophotographic image forming apparatus. A process-cartridge-type apparatus is advantageous in that maintenance of the apparatus can be carried out by the user in effect without the necessity for the serviceman. Therefore, the operability can be drastically improved. And, the process-cartridge-type apparatus is widely used in an electrophotographic image forming apparatus.

A description will be provided as to a structure of such a process cartridge. The process cartridge contains an electrophotographic photosensitive drum (photosensitive drum), a cleaning member for cleaning the photosensitive drum, a charging member for applying charge to the photosensitive drum, a developing roller for supplying a developer to the photosensitive drum, a developing blade for regulating an amount of the developer deposited on the developing roller, and a developer accommodating portion for accommodating the developer.

A so-called supplying type is also known. In the supplying type, a developer cartridge and a process cartridge are mounted to the main assembly of the electrophotographic image forming apparatus, and in the mounted state, the developer is supplied from the developer cartridge to the process cartridge.

On the other hand, a developer not transferred onto the recording material when a developed image formed on the photosensitive drum is transferred onto the recording material, is removed by the cleaning member.

The cleaning member has an elastic member such as rubber. A method for collecting the developer removed from the photosensitive drum is known in which the developer is accommodated in a developer collection space provided in the developer cartridge.

Recently, it is desired in the electrophotographic image forming apparatus of the supplying type that developer accommodating portion has a sufficient volume, and simultaneously the electrophotographic image forming apparatus is downsized.

SUMMARY OF THE INVENTION

Accordingly, it is a principal object of the present invention to provide an electrophotographic image forming apparatus using a developer cartridge and a process cartridge that is downsized, and a process cartridge contributable to the downsizing of the apparatus.

It is another object of the present invention to provide an electrophotographic image forming apparatus, wherein a developer is supplied into a process cartridge from a developer cartridge, wherein when the process cartridge and the developer cartridge are mounted to the main assembly of the apparatus, a second removed developer accommodating portion is disposed at a side of the developer cartridge, and a process cartridge, which is contributable to downsizing of the apparatus.

According to an aspect of the present invention, there is provided an electrophotographic image forming apparatus to which a process cartridge and a developer cartridge for supplying a developer to the process cartridge independently from each other are mountable. The apparatus comprises i) the process cartridge including, an electrophotographic photosensitive drum, a developing roller for developing an electrostatic latent image formed on the electrophotographic photosensitive drum, a first developer accommodating portion for accommodating a developer to be used for development of the electrostatic latent image by the developing roller, and a developer receiving port for receiving the developer from the developer cartridge into the first developer accommodating portion when the process cartridge is mounted to the image forming apparatus. The developer receiving port faces upwardly when the process cartridge is mounted to the image forming apparatus. The cartridge also comprises cleaning member for removing the developer from the electrophotographic photosensitive drum, a first removed developer accommodating portion for accommodating the developer removed from the electrophotographic photosensitive drum by the cleaning member, and a second removed developer accommodating portion for accommodating the developer fed from the first removed developer accommodating portion. The second removed developer accommodating portion is disposed above the first removed developer accommodating portion when the process cartridge is mounted to the image forming apparatus. The second removed developer accommodating portion is projected upwardly beyond the developer receiving port with respect to a vertical direction when the process cartridge is mounted to the image forming apparatus. The cartridge further comprises developer feeding means for feeding the developer from the first removed developer accommodating portion to the second removed developer accommodating portion. The apparatus also comprises ii) the developer cartridge including, a second developer accommodating portion for accommodating the developer to be supplied to the process cartridge, and a developer supply port for supplying the developer to the first developer accommodating portion through the developer receiving port, the developer supply port facing downwardly when the developer cartridge is mounted to the main assembly of the apparatus. In addition, when the process cartridge and the developer cartridge are mounted to each other, the developer cartridge is disposed above the first developer accommodating portion and at a side of the second removed developer accommodating portion.

DESCRIPTION OF THE PREFERRED EMBODIMENTS

A description will be provided as to a color electrophotographic image forming apparatus according to a first embodiment of the present invention, referring to the accompanying drawings.

In the following description, a "longitudinal direction" means a direction in which the process cartridge is mounted to the color electrophotographic image forming apparatus. The longitudinal direction is a direction which crosses (i.e., is substantially perpendicular to) a feeding direction of the recording material S, and therefore, is substantially the same as the direction of the axis of a photosensitive drum 1. A "widthwise direction" means a left-right direction as seen in the axis direction, that, is a direction crossing the longitudinal direction. A "vertical direction" means the vertical direction when a process cartridge and/or a developer cartridge in addition mounted to the main assembly of the apparatus.

(General Arrangement of Color Electrophotographic Image Forming Apparatus).

Figure 1:
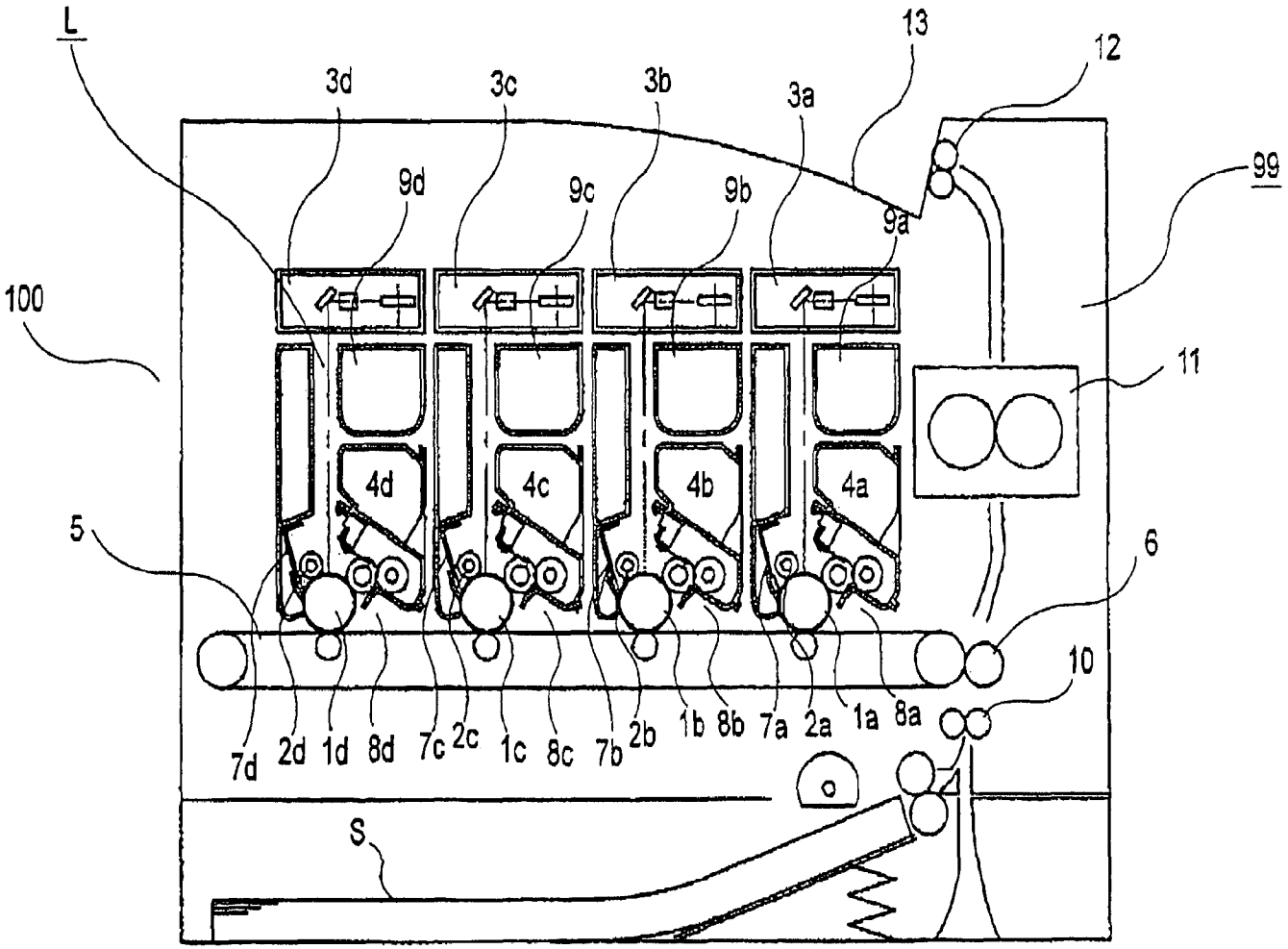
FIG. 1 is a longitudinal sectional view showing a full-color image forming apparatus according to an embodiment of the present invention.

Referring to FIG. 1, a description will be provided as to the general arrangement of the color electrophotographic image forming apparatus of a supplying type. FIG. 1 is a longitudinal sectional view illustrating the color electrophotographic image forming apparatus (full-color laser beam printer) 100 of the supplying type.

The image forming apparatus 100 comprises four photosensitive drums 1*a*, 1*b*, 1*c*, and 1*d*, each of which is also denoted by reference numeral 1, which are disposed horizontally in parallel with each other. The photosensitive drum 1 is rotational driven by driving means (unshown). Around the photosensitive drums 1, there are provided charging rollers 2 (2*a*, 2*b*, 2*c*, 2*d*), scanner units (3*a*, 3*b*, 3*c*, 3*d*), developing units 4 (4*a*, 4*b*, 4*c*, 4*d*), an intermediary transfer belt 5, and cleaning blades 7 (7*a*, 7*b*, 7*c*, 7*d*), as shown in FIG. 1. The charging rollers 2 (2*a*, 2*b*, 2*c*, 2*d*) are effective to uniformly charge peripheral surfaces of the respective photosensitive drums 1. The scanner units (3*a*, 3*b*, 3*c*, 3*d*) project laser beams L to the photosensitive drums 1 corresponding to the image information, so that electrostatic latent images are formed on the respective photosensitive drums 1. The developing units 4 (4*a*, 4*b*, 4*c*, 4*d*) develop the respective electrostatic latent images with developers into developed images. The developing unit 4 is disposed at one side of the photosensitive drum 1 with respect to the widthwise direction of the photosensitive drum 1. The intermediary transfer belt 5 functions to receive the developed images formed on the photosensitive drums 1. The cleaning blade 7 (7*a*, 7*b*, 7*c*, 7*d*) function to remove residual developer remaining on the peripheral surfaces of the photosensitive drums 1 after the image transfer operations, respectively. A secondary transfer roller 6 transfers the developed image transferred onto the intermediary transfer belt 5 onto a recording material S.

The photosensitive drum 1, the charging roller 2, the developing unit 4 and the cleaning blade 7 are unified to constitute a process cartridge 8 (8*a*, 8*b*, 8*c*, 8*d*). Above the process cartridges 8, developer cartridges 9 (9*a*, 9*b*, 9*c*, 9*d*) for supplying the developers into the process cartridge 8 are demountably provided (the structure of the frame of the process cartridge 8 will be described hereinafter). The process cartridges 8 are positioned correctly at respective positioning portions provided in the main assembly 99 of the apparatus 100, by portions to be positioned 81-83. The developer cartridges 9 are positioned correctly at respective positioning portions provided in the main assembly 99 of the apparatus 100, by positioning portions 92, 93.

A description will be provided as to image forming operation.

The photosensitive drums 1*a*, 1*b*, 1*c*, and 1*d* are sequentially rotational driven at image formation timings. The scanner units corresponding to the respective process cartridges 8 are sequentially actuated. By the rotation of the photosensitive drum 1, the charging roller 2 contacted to the photosensitive drum 1 is rotated by the photosensitive drum 1. By the application of a bias to the charging roller 2, the peripheral surface of the photosensitive drum 1 is uniformly charged electrically. The scanner units selectively apply image light in accordance with the image information onto the peripheral surface of the photosensitive drum 1. By this, an electrostatic latent image is formed on the peripheral surface of the photosensitive drum 1. The developing roller 17 provided in the developing unit 4 functions to transfer the developer to the electrostatic latent image to develop the peripheral surface of the photosensitive drum 1 into a developed image. Thus, the developing roller 17 has a function of developing the electrostatic latent image formed on the photosensitive drum 1. The developed image is transferred all together onto an intermediary transfer belt 5 from the photosensitive drum 1. Thereafter, the developed image is fed to the position of the secondary transfer roller 6 by the intermediary transfer belt 5.

A pair of registration rollers 10 starts to rotate to further feed the recording material S at such timing that the leading end of the developed image on the peripheral surface of the intermediary transfer belt 6 is aligned with a starting position of image formation of the recording material S. The recording material S thus fed receives the developed image from the peripheral surface of the intermediary transfer belt 5 by the secondary transfer roller 6.

The recording material S now having the transferred developed images is fed to the fixing portion 11. The recording material S is subjected to a heat fixing operation in the fixing portion 11 so that the developed image is fixed on the recording material S. Thereafter, the recording material S is discharged to the outside of the main assembly from a discharging portion 13 by a pair of discharging rollers 12 with the image surface facing down.

(Structure of Frame of Process Cartridge).

Figure 2:
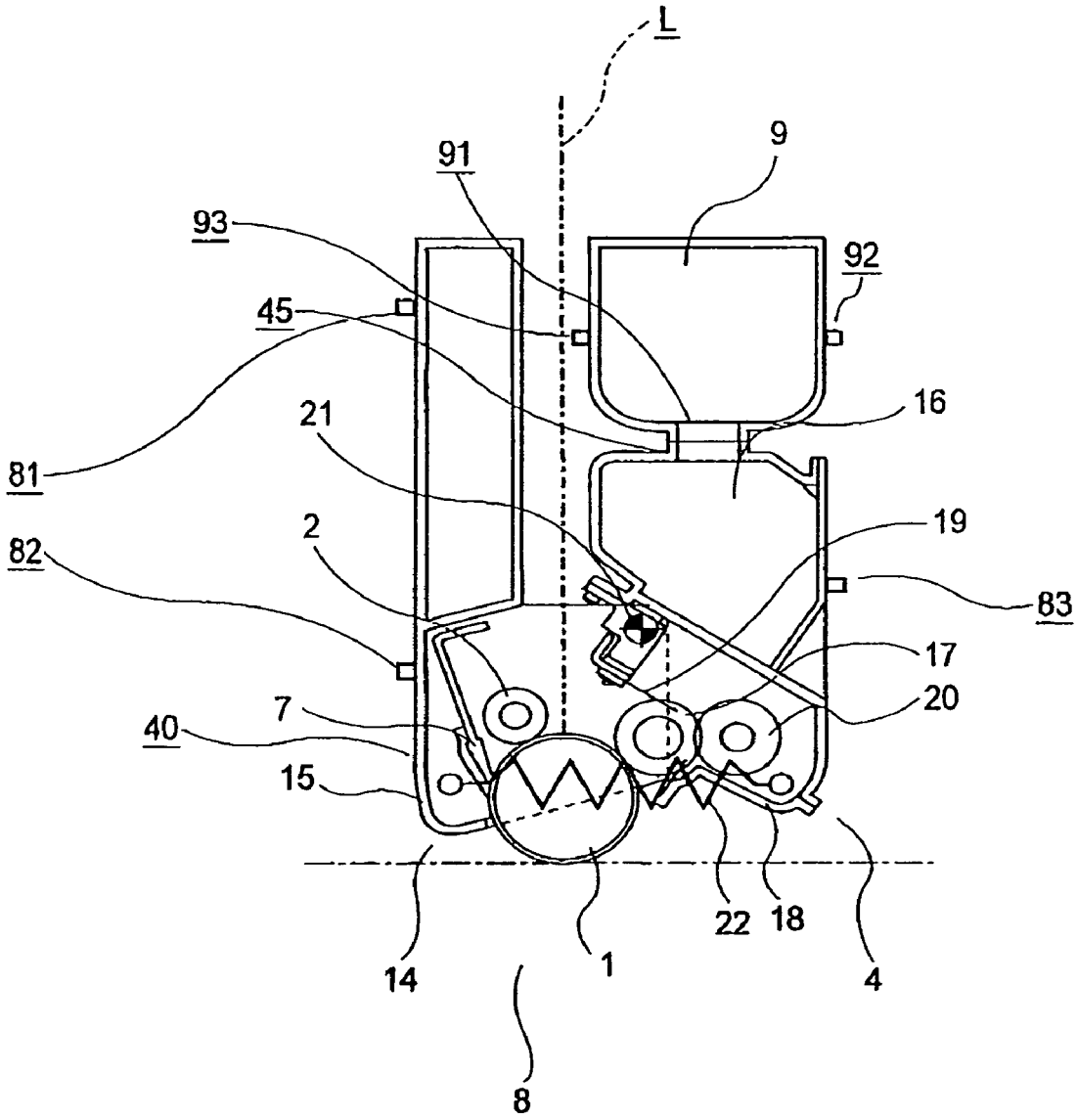
FIG. 2 is a longitudinal sectional view of a part around the process cartridge according to the embodiment of the present invention.

Referring to FIG. 2, the structures of the process cartridge 8 will be described.

As shown in FIG. 2, the cartridge 8 comprises a photosensitive drum unit 14 and a developing unit 4 which are integral with each other. Here, the developing unit 4 is movably mounted on the drum unit 14.

The drum unit 14 has a cleaner container 15, which is a frame rotatably supporting the photosensitive drum 1. Here, the cleaner container 15 extends over an entire area of the photosensitive drum 1 with respect to the axial (longitudinal) direction. The cleaner container 15 also supports the charging roller 2 and the blade 7. The cleaner container 15 has a first removed developer accommodating portion 40 for accommodating the developer removed from the photosensitive drum 1 by the blade 7.

On the other hand, the developing unit 4 comprises a developer accommodating container 16 (developer accommodating portion) for accommodating the developer and a developing container 18, which are connected with each other by ultrasonic welding or the like. Here, the developer accommodating container 16 functions to accommodate the developer supplied from the developer cartridge 9. The developer is used for developing the electrostatic latent image. The developer accommodating container 16 has a developer receiving port 45 for receiving the developer from outside of the process cartridge 8. Thus, the receiving port 45 is to receive the developer accommodated in the developer cartridge 9. The receiving port 45 is disposed above the developer accommodating container 16. Normally, the receiving port 45 is covered by a shutter (unshown) so that developer does not scatter out. On the other hand, the developer supply port 91 provided in the developer cartridge 9 functions to receive the developer into the process cartridge 8 through the receiving port 45. Normally, the supply port 91 is covered by a shutter (unshown) so that developer does not scatter out. When the process cartridge 8 and the developer cartridge 9 are mounted to the main assembly 99 of the apparatus 100, the shutters (unshown) are retracted from the receiving port 45 and from the supply port, so that the receiving port 45 and the supply port are directly opposed to each other. By this, the developer is received into the process cartridge 8. The receiving port 45 is so disposed that when the process cartridge 8 is mounted to the main assembly 99 of the apparatus 100, the receiving port 45 faces up. Correspondingly, the supply port 91 is so disposed that when the developer cartridge 9 is mounted to the main assembly 99 of the apparatus 100, the supply port 91 faces down. Therefore, when the developer cartridge 9 is mounted to the main assembly 99 of the apparatus 100, the developer is supplied through the supply port 91 and the receiving port into the process cartridge 8 which is set in the main assembly 99 of the apparatus 100. The developing container 18 rotatably supports the developing roller 17 for developing the electrostatic latent image with the developer in the developer accommodating container 16.

In the developing container 18, there are provided the developing roller 17, a developing blade 19, and a developer supplying roller 20 and so on. The developing blade 19 functions to regulate a layer thickness of the developer deposited on the peripheral surface of the developing roller 17. The developer supplying roller 20 is a sponge roller for supplying the developer onto the peripheral surface of the developing roller 17.

The developing unit 4 is supported on the photosensitive drum unit 14 swingably about a connecting portion 21 therebetween. The developing unit 4 is urged toward the photosensitive drum unit 14 by an elastic member 22 such as a spring. By doing so, the developing roller 17 is contacted to the photosensitive drum 1.

(Structure for Collection of Removed Developer in Process Cartridge).

Figure 3:
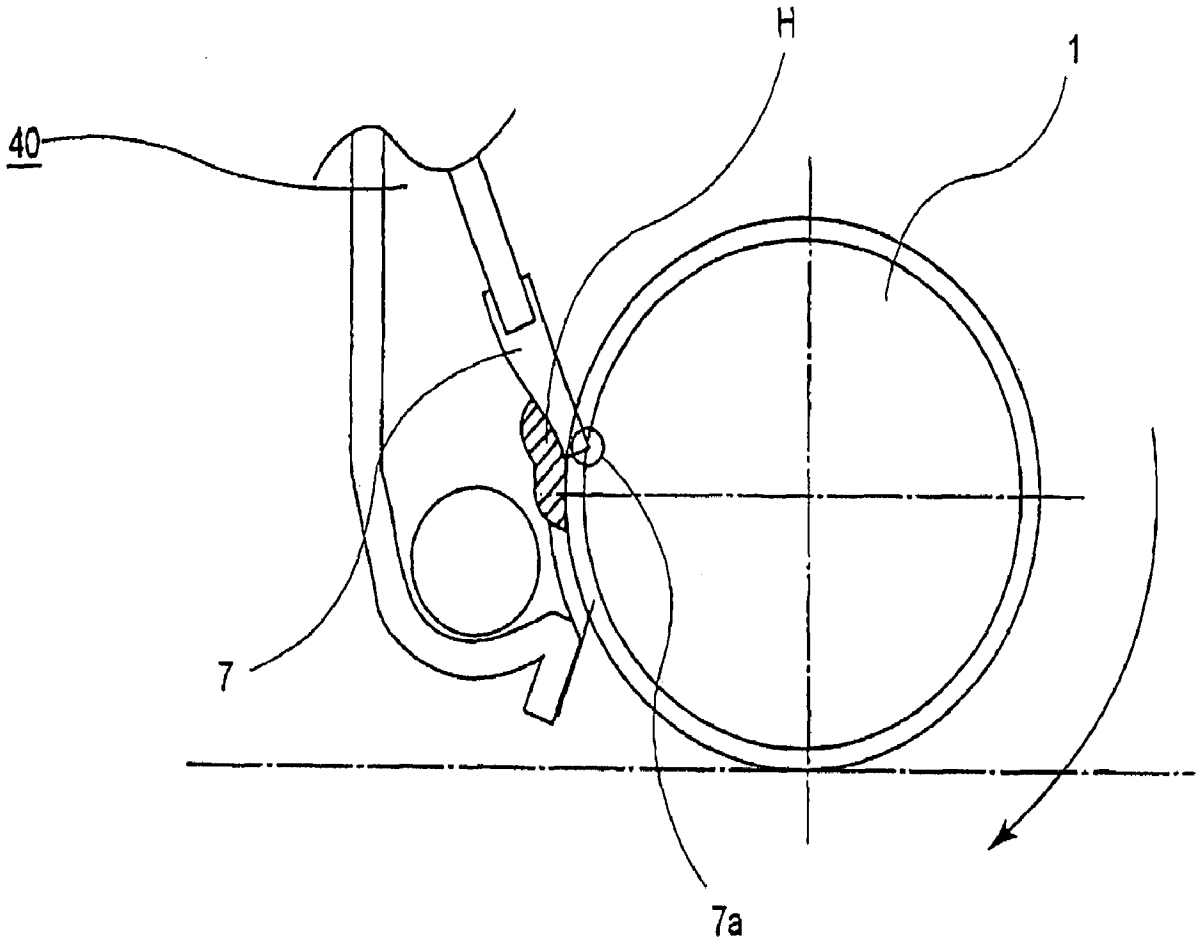
FIG. 3 is a sectional view illustrating a structure of a cleaning blade.
Figure 4:
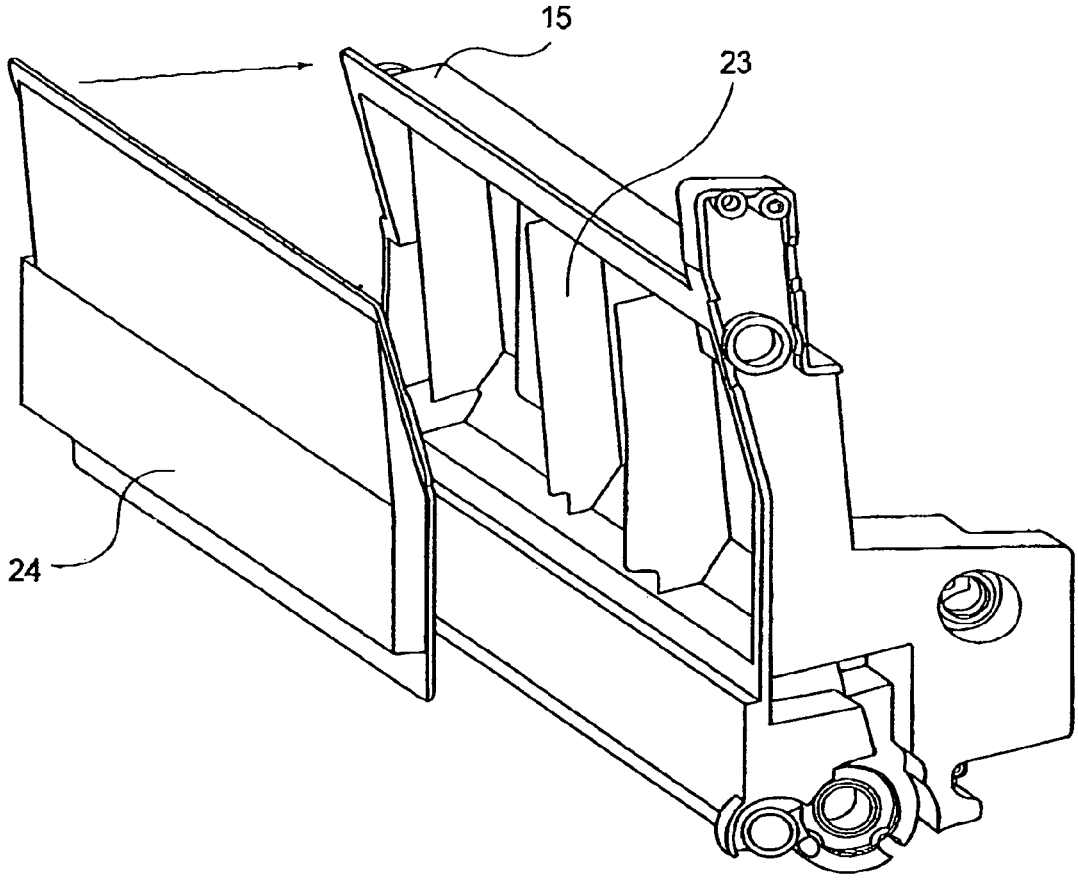
FIG. 4 is a perspective view illustrating a collection space for a residual developer according to an embodiment of the present invention.
Figure 5:
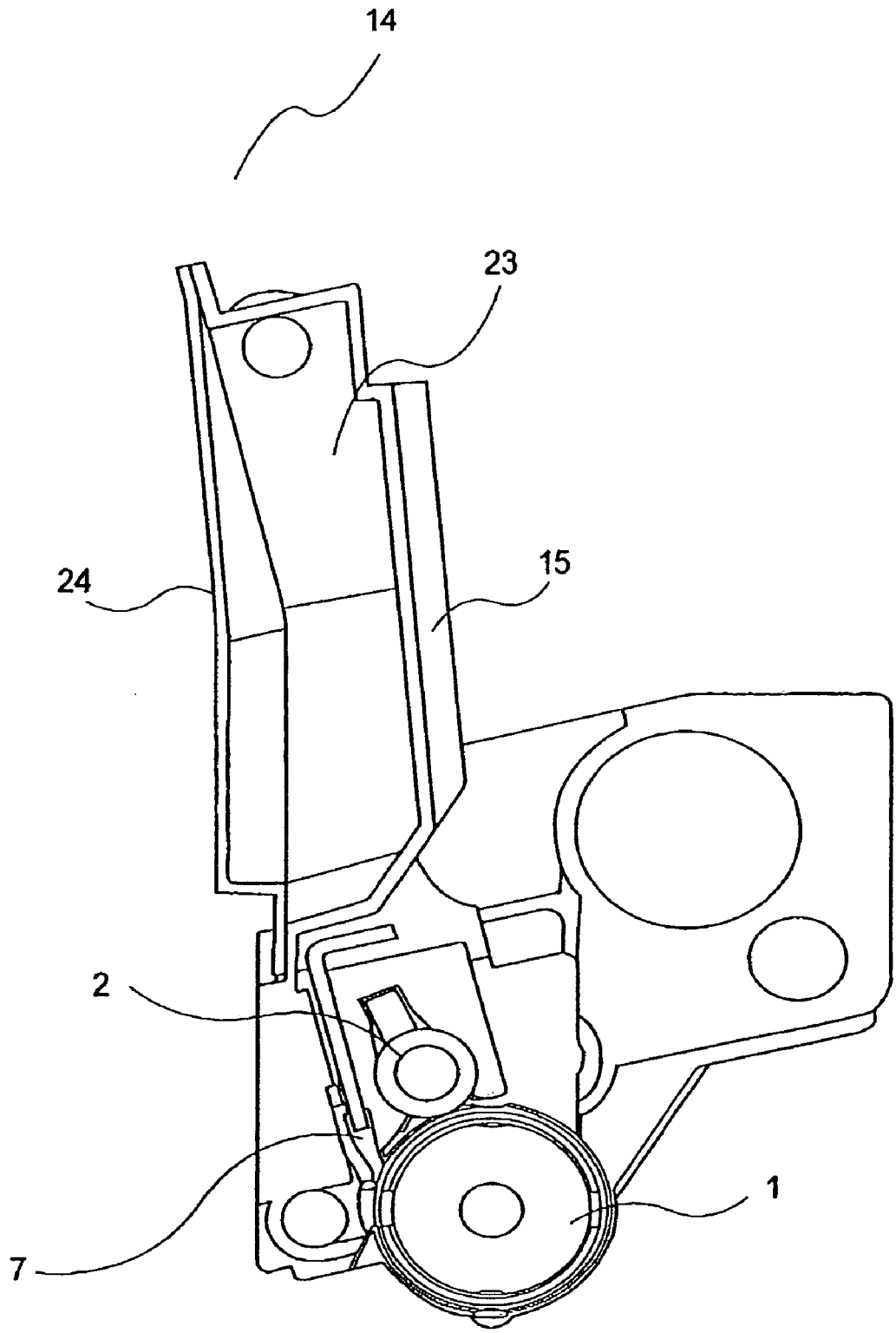
FIG. 5 is a sectional view illustrating a structure of the residual developer collection space according to an embodiment of the present invention.

Referring to FIGS. 3-5, a description will be provided as to structures for collecting the developer removed from the photosensitive drum 1 in the process cartridge 8.

The developed image formed on the photosensitive drum 1 is transferred all together onto the intermediary transfer belt 5. At this time, not the entire developed image formed on the photosensitive drum 1 is transferred onto the intermediary transfer member 5, but a small amount of the developer is not so transferred and remains on the photosensitive drum 1.

The developer remaining on the photosensitive drum 1 is removed by the cleaning blade 7. As shown in FIG. 3, the blade 7 is a blade member of an elastic member, such as rubber. The edge portion 7*a* of the blade 7 is contacted on the surface of the photosensitive drum 1 over the entire area with respect to the longitudinal direction. By doing so, the developer H deposited on the photosensitive drum 1 is scraped.

The developer removed by the blade 7 is once accommodated into the first removed developer accommodating portion 40. The first removed developer accommodating portion 40 is positioned at the opposite side of the photosensitive drum 1 with respect to the widthwise direction as seen in the direction of the axis of the photosensitive drum 1. The removed developer H thus accommodated in the first removed developer accommodating portion 40 is fed to a second removed developer accommodating portion 23. As shown in FIGS. 4, 5, the second removed developer accommodating portion 23 extends over the entire area of the process cartridge 8 with respect to the longitudinal direction. The second removed developer accommodating portion 23 is constituted by connecting the cleaner container 15 and another member, i.e. a cover or covering member 24 welded together by ultrasonic welding or the like.

(Disposition of Second Removed Developer Accommodating Portion).

Figure 6:
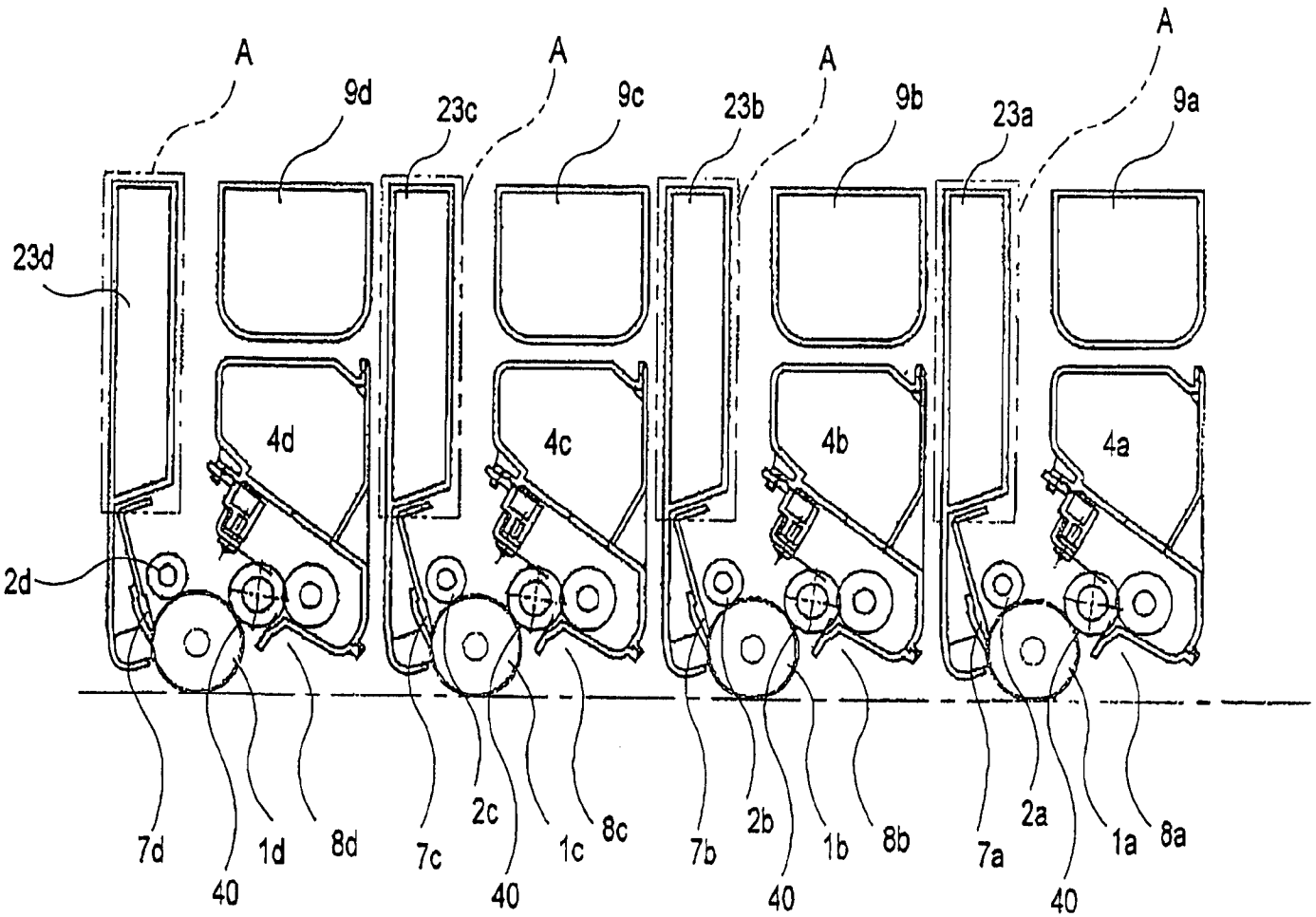
FIG. 6 is a side view illustrating a disposition of the residual developer collection space.

As shown in FIG. 6, the second removed developer accommodating portion 23 is disposed above the first removed developer accommodating portion 40 in a state in which the cartridge 8 is set in the main assembly 99 of the apparatus 100. The developer accommodating portion 23 is projected vertically up beyond the developer receiving port 45 (FIG. 2). In other words, the developer accommodating portion 23 is interposed between the adjacent developer cartridges 9 disposed above the developing units 4 (at the position indicated by An in the Figure). By disposing the second removed developer accommodating portion 23 at such a position in the supplying type image forming apparatus 100, the process cartridge 8 and the electrophotographic image forming apparatus can be downsized. More particularly, the dimensions thereof can be reduced in the horizontal direction. This means that bottom area (foot print) of the process cartridge 8 can be reduced.

In this embodiment, the second removed developer accommodating portion 23 is disposed at a position above the first removed developer accommodating portion 40, that is, the region An in FIG. 6. The second removed developer accommodating portion 23 is projected upward beyond the developing unit 4 with respect to the vertical direction, when the process cartridge 8 and the developer cartridge 9 are mounted to the main assembly 99 of the apparatus 100. In other words, the second removed developer accommodating portion 23 overlaps the developer cartridge 9 with respect to the horizontal direction when the process cartridge 8 and the developer cartridge 9 are mounted to the main assembly 99 of the apparatus 100. In addition, the developer cartridge 9 and the developing unit 4 overlap with each other as seen in the vertical direction. The developer cartridge 9 and the process cartridge 8 are disposed, so that laser beam L can pass through between the developer cartridge 9 and the second removed developer accommodating portion 23. By doing so, the process cartridge 8 and the developer cartridge 9 can be efficiently disposed in the main assembly 99 of the apparatus 100. This leads to downsizing of the apparatus.

(Structures for Feeding Removed Developer).

The structures for feeding the removed developer in the process cartridge will be described.

Figure 8:
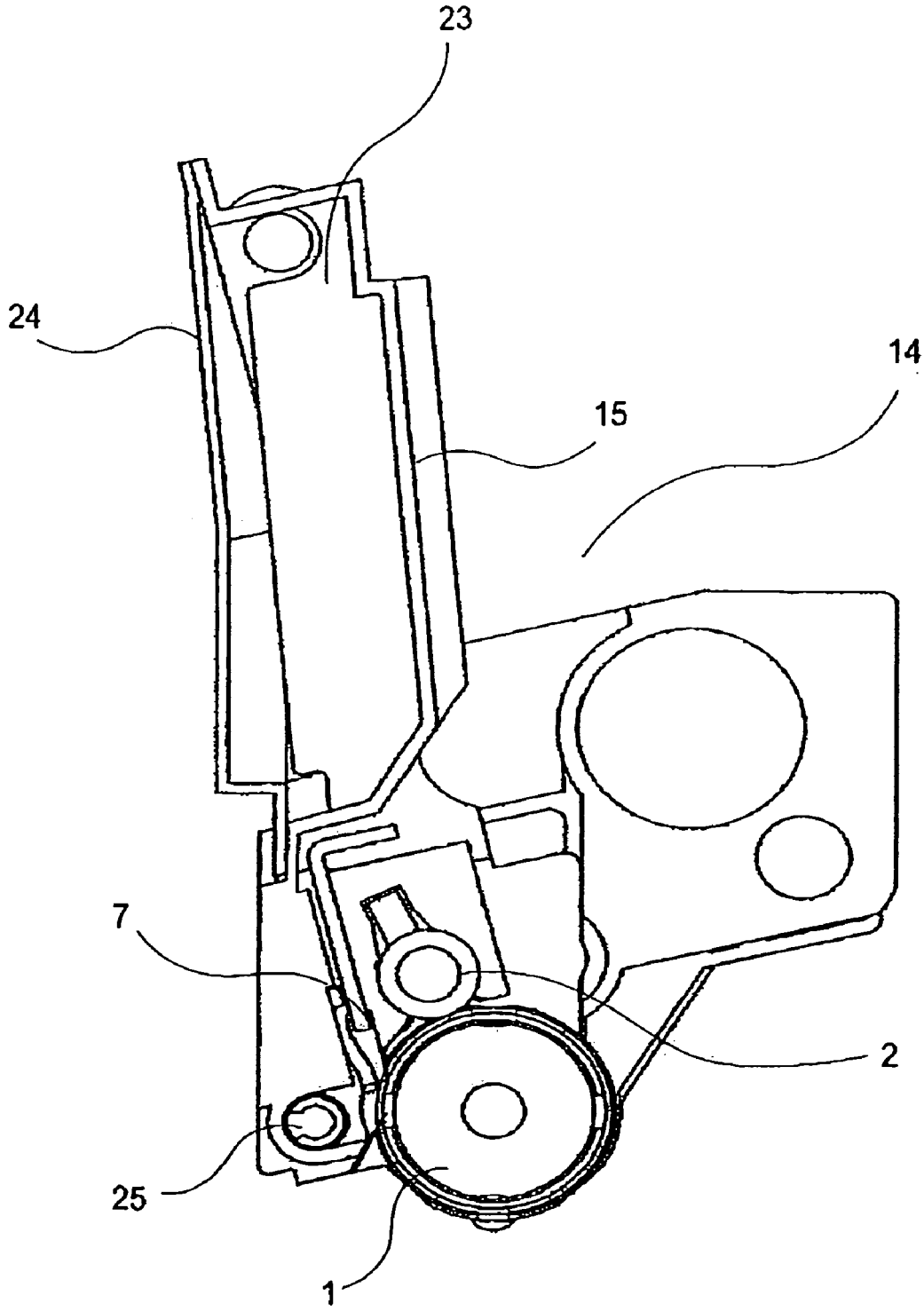
FIG. 8 is a perspective view showing a structure of a first screw according to an embodiment of the present invention.

As shown in FIG. 8, a first screw member 25 is extended over the entire longitudinal area at the side opposite from the contact part between the blade 7 and the photosensitive drum 1. The developer scraped by the blade 7 is fed by the first screw member 25 toward one longitudinal end of the process cartridge 8 (in the direction of an arrow F in FIG. 9).

Figure 9:
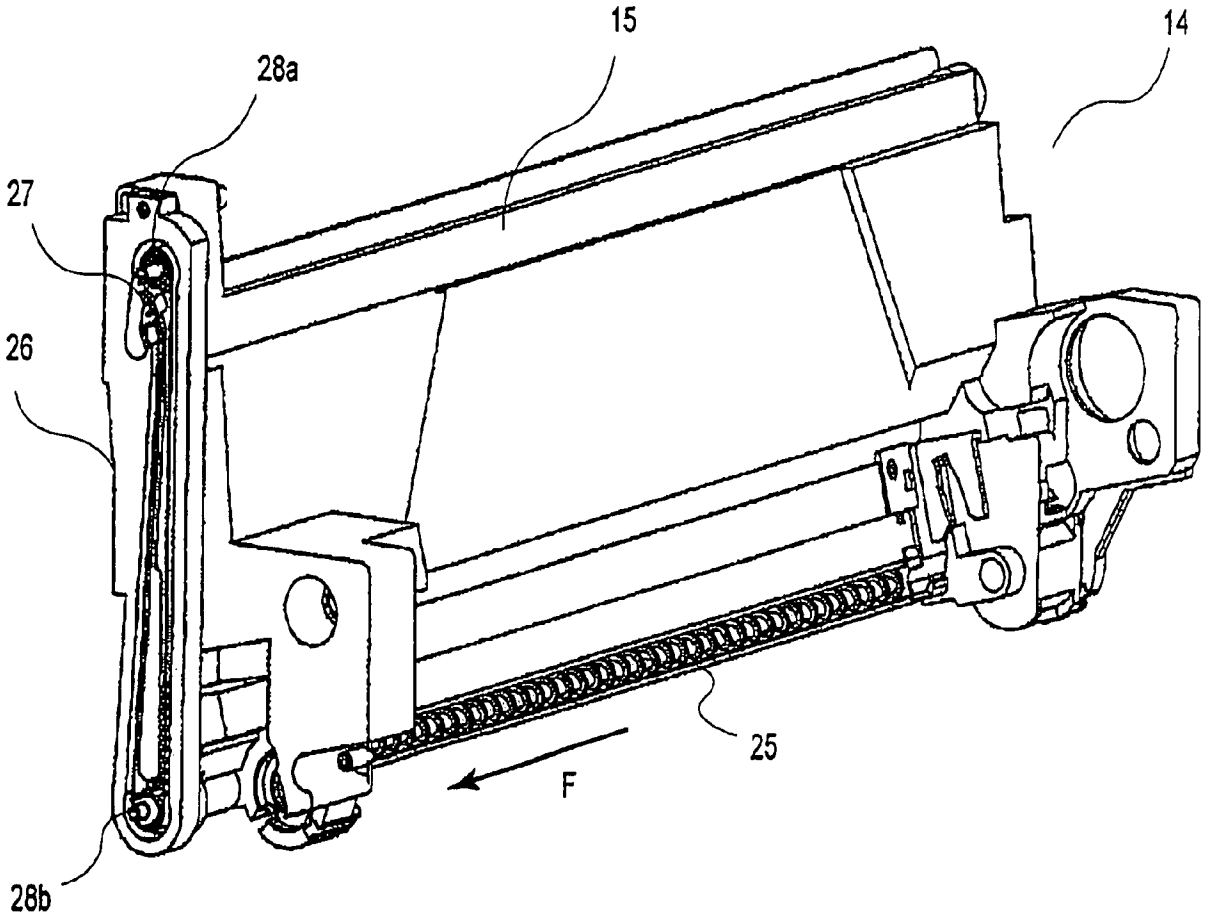
FIG. 9 is a perspective view showing a structure of a feeding unit according to an embodiment of the present invention.

As shown in FIG. 9, a feeding unit 26 (developer feeding member) is provided at one longitudinal end of the process cartridge 8 to feed the removed developer upwardly. The developer fed by the first screw member 25, is further fed to a second removed developer accommodating portion 23 by the feeding unit 26. The first screw member 25 and the feeding unit 26 are connected with each other. The feeding unit 26 includes an endless timing belt 27 having teeth at both sides thereof. The belt 27 is made of rubber material having a core member or a resin material member without a core wire. When the use is made with a timing belt of resin material without a core metal, the material is preferably a polyester elastomer material.

Inner teeth 27*a* of the belt 27 are engaged with a rotatable upper pulley member 28*a* and a rotatable lower pulley member 28*b*. The belt 27 is positioned at the opposite ends by the two pulley members 28*a*, 28*b*. By rotating one of the pulley members 28*a*, 28*b*, the belt 27 is rotated. The circumferential length of the belt 27 is slightly shorter as compared with the distance between the axes of the upper pulley member 28*a* and the lower pulley member 28*b*. By doing so, when the belt 27 is positioned around the upper pulley member 28*a* and the lower pulley member 28*b*, a predetermined tension is applied.

If the tension of the belt 27 is too high, the required rotational torque of the belt 27 is high. On the contrary, if the tension is too low, the pulley members 28*a*, 28*b* may rotate in a skipping manner relative to the timing belt 27. Therefore, it is preferable to apply the tension to such an extent that the elongation of the belt 27 is approx. 1.5-2.0% when the above-described belt 27 is positioned around the upper pulley member 28*a* and the lower pulley member 28*b*.

Figure 10:
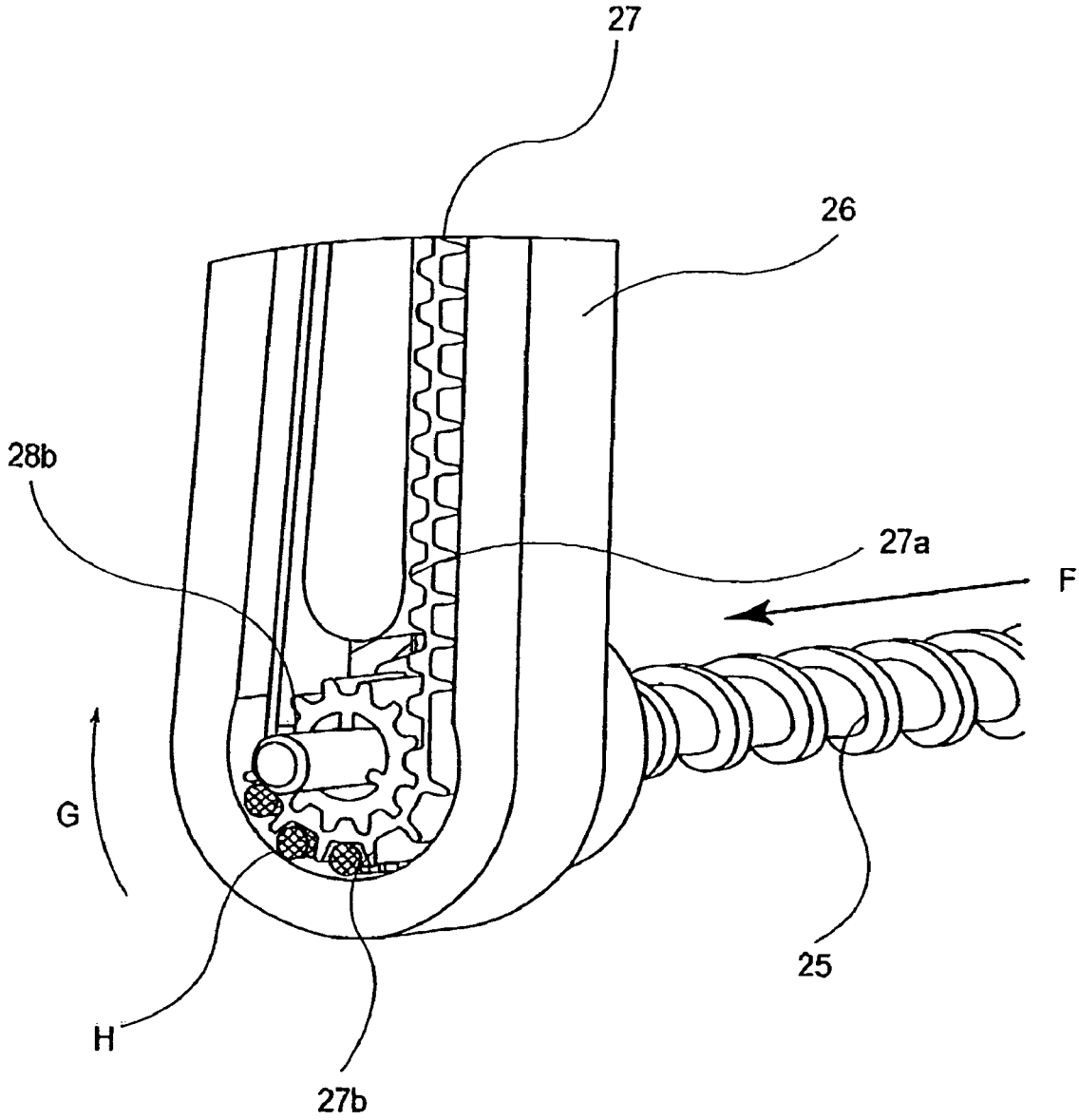
FIG. 10 is an illustration of the feeding performance of a timing belt according to an embodiment of the present invention.

As shown in FIG. 10, the residual developer H fed by the first screw member 25, enters the gaps between outer teeth 27*b* of the belt 27. By the rotation of the belt 27 in the direction indicated by an arrow G, the residual developer H is fed upwardly.

Figure 11:
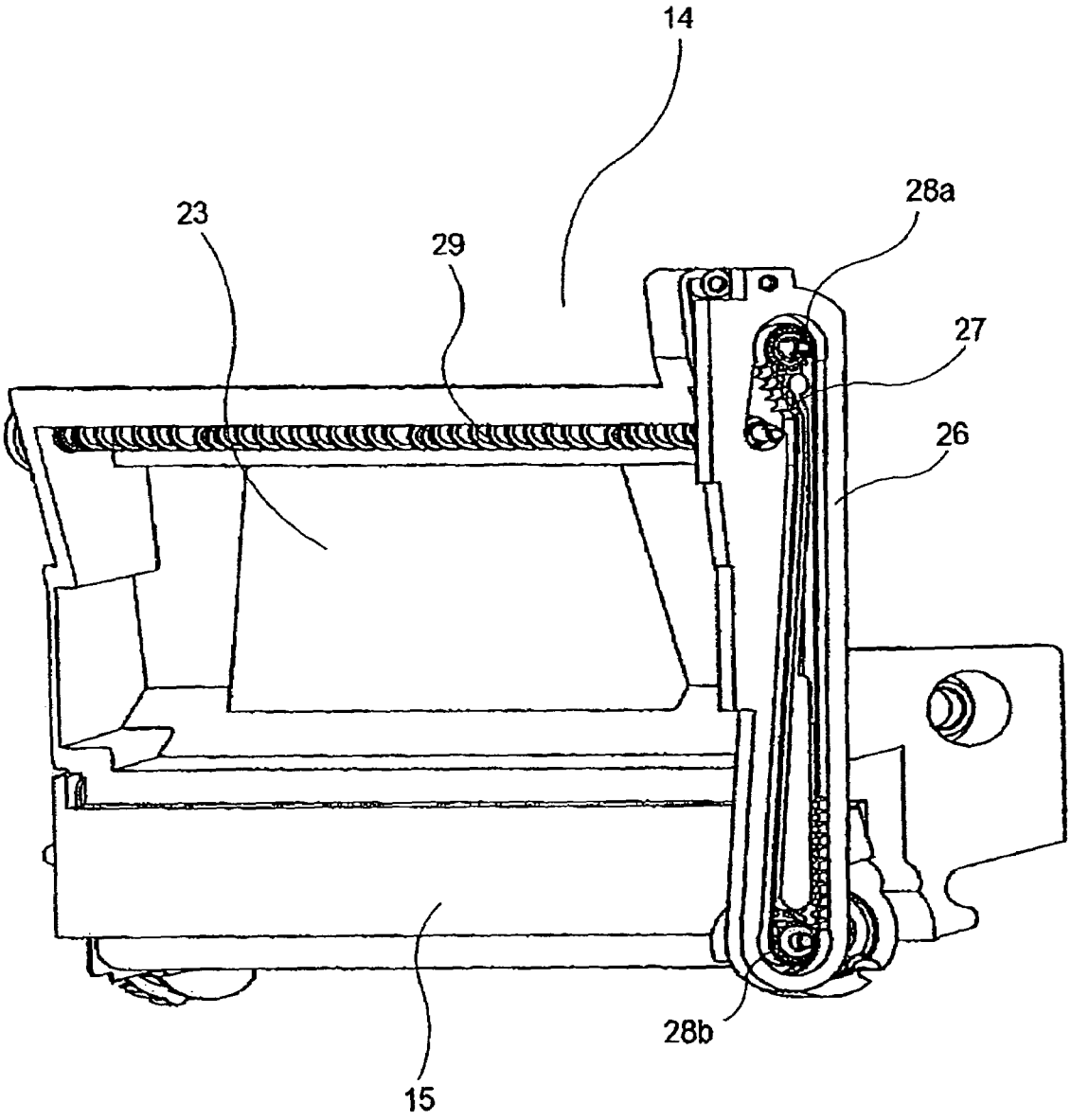
FIG. 11 is a perspective view showing a structure of a second screw according to an embodiment of the present invention.

As shown in FIG. 11, the residual developer H fed upwardly by the belt 27 is fed to the second screw member 29 coupled to an upper side of the feeding unit 26. The second screw member 29 extends over the entire longitudinal area of the second removed developer accommodating portion 23.

Figure 12:
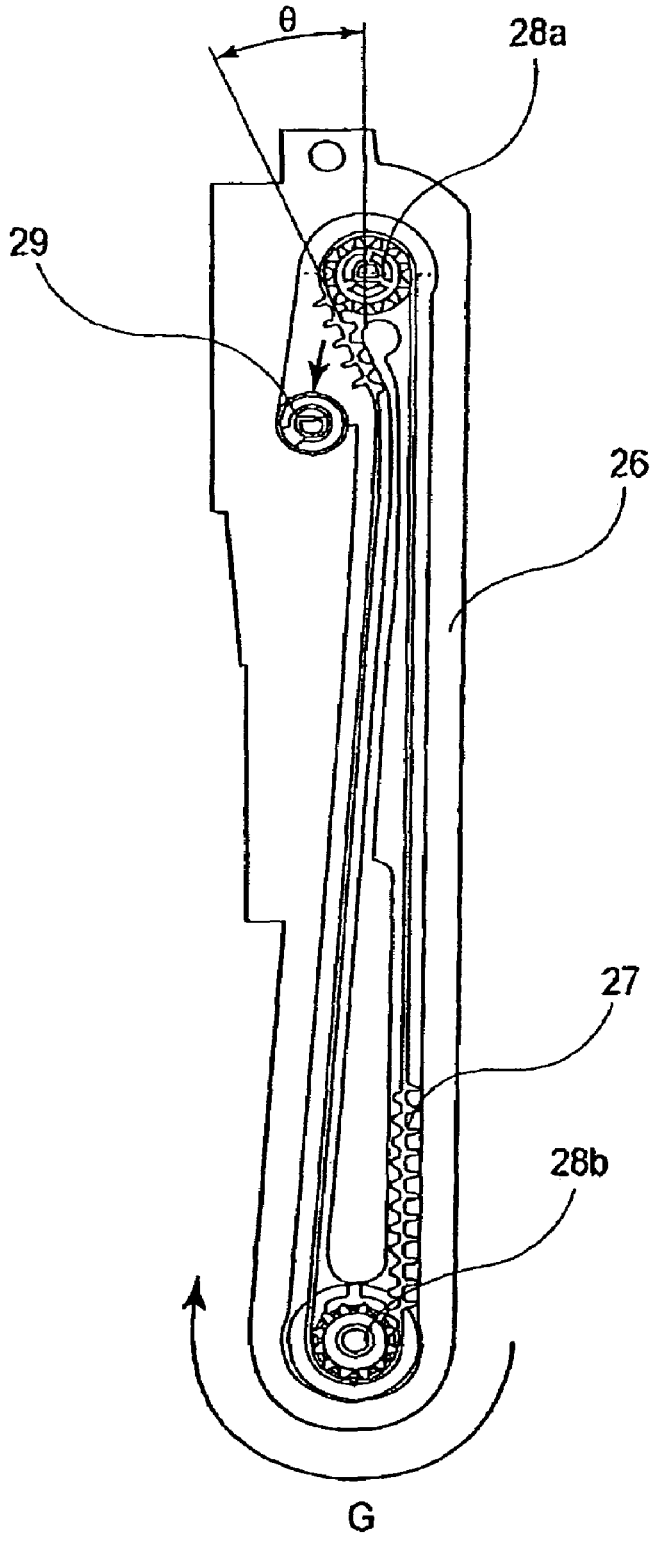
FIG. 12 is an illustration of a structure of a timing belt according to an embodiment of the present invention.

As shown in FIG. 12, the positional relation between the belt 27 and the second screw member 29 is as follows. As seen in the longitudinal direction, above the second screw member 29, the belt 27 extends at an angle Θ relative to the vertical direction. With this structure, the belt 27 can efficiently feed the developer H to the second screw member 29. If the belt 27 extends vertically above the second screw member 29, the developer H in the gaps between the outer teeth 27*b* are not easily fed to the second screw member 29. For this reason, the belt 27 extends with the angle Θ at the portion above the second screw member 29. Using this angle, the developer H falls from the belt 27 to the second screw member 29. Here, the angle Θ is preferably not less than 10°.

Figure 13:
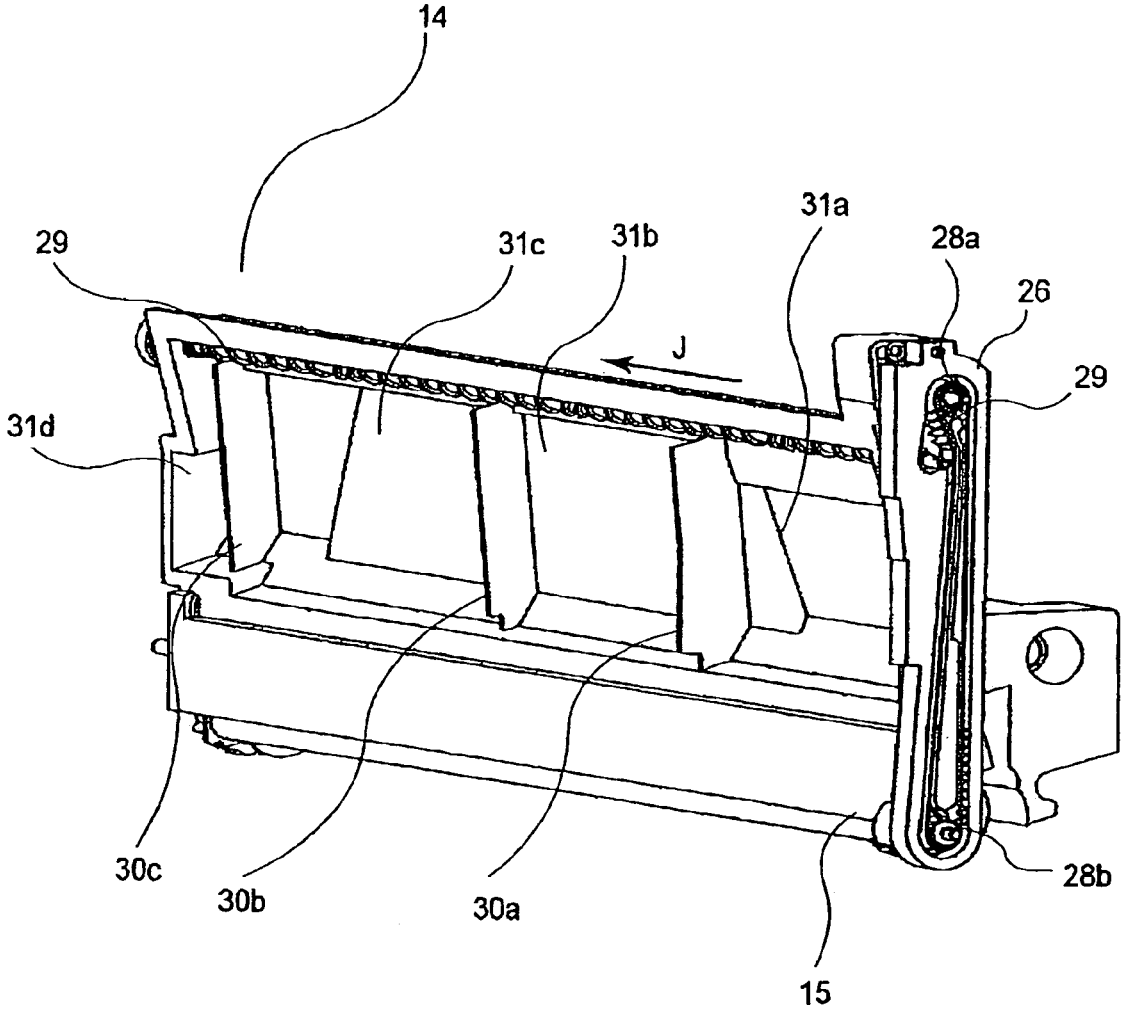
FIG. 13 is a perspective view illustrating a collection space for a residual developer according to an embodiment of the present invention.

Then, as shown in FIG. 13, the developer fed by the second screw member 29 from the upstream-side to a second removed developer accommodating portion 23 (in the direction of the arrow J in FIG. 13). An inner space of the second removed developer accommodating portion 23 is separated by partition walls 30*a-c* into a plurality of spaces 31*a-d*.

Figure 14:
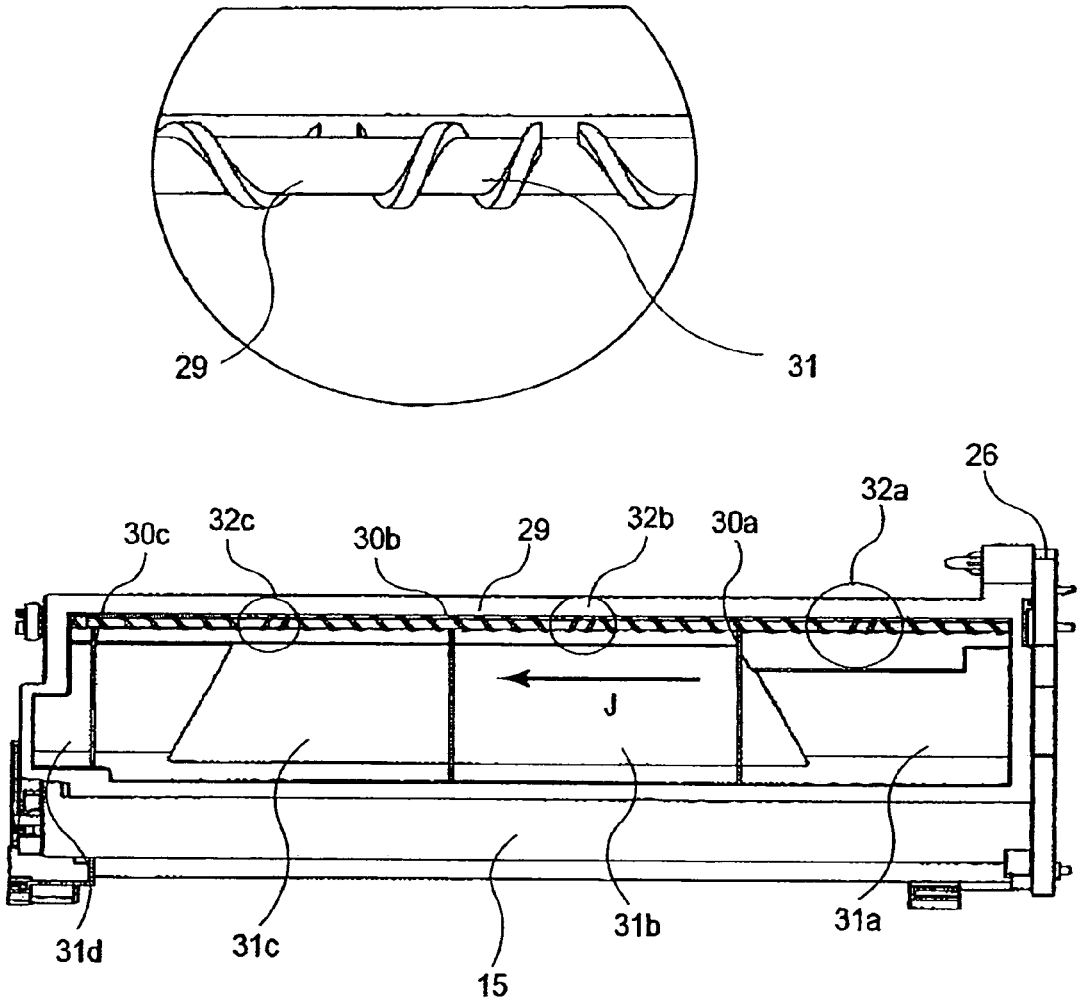
FIG. 14 is a front view illustrating a structure of a removed developer collection portion according to an embodiment of the present invention.

As shown in FIG. 14, the second screw member 29 is provided at the central part of each of the spaces 31*a-d* with one or two turns of opposite screw (reverse screw parts 32*a-d*) which are twisted in the direction opposite to the developer feeding direction (the direction of the arrow J in the FIG. 14). With this structure, the developer fed by the second screw member 29 is pushed back in the opposite direction by the opposite screw part 32*a-d*.

Figure 15:
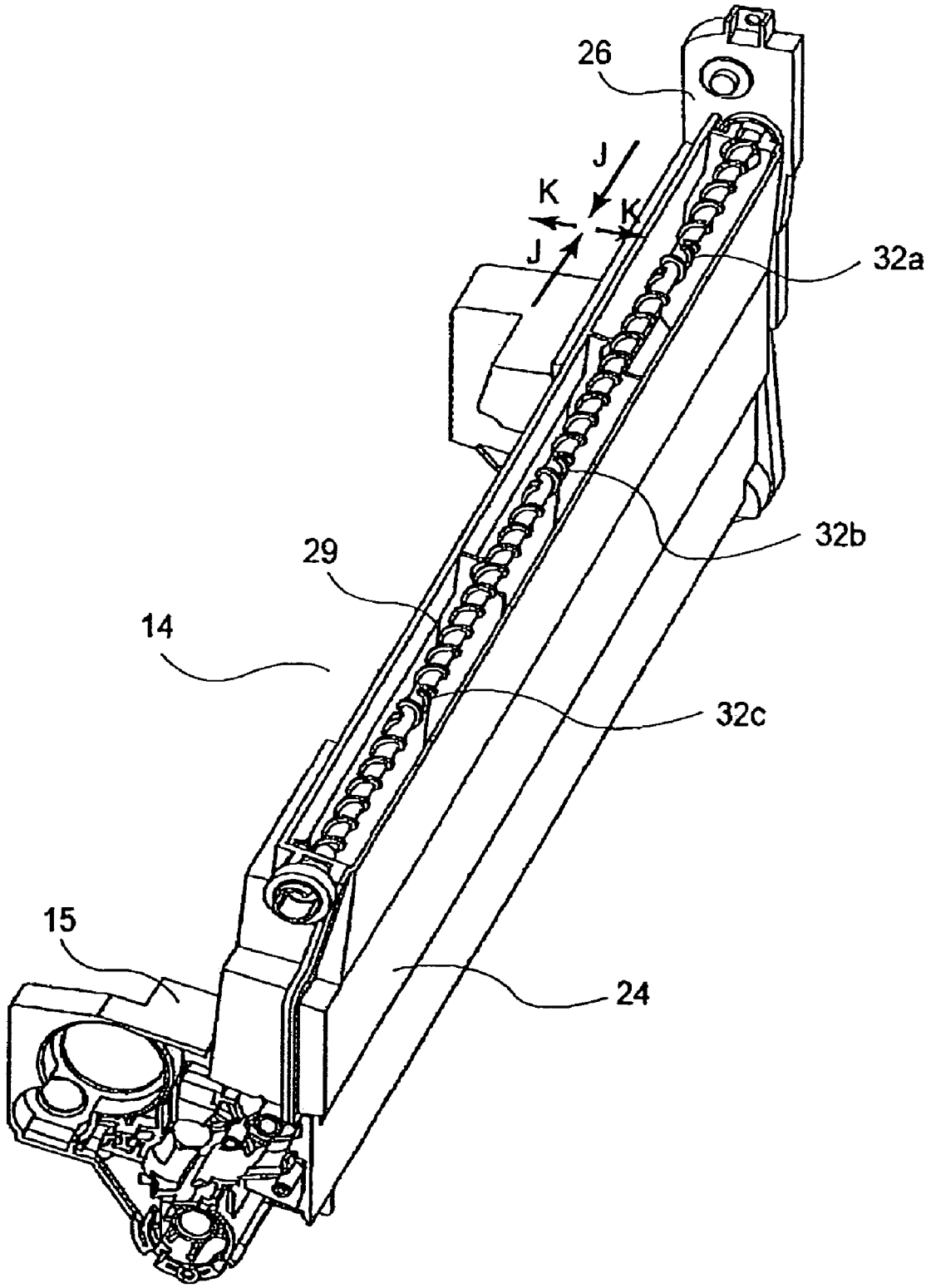
FIG. 15 is a perspective view showing a structure of the removed developer collection portion according to an embodiment of the present invention.

Therefore, as shown in FIG. 15, the developer expands in the direction perpendicular to the developer feeding direction (in the direction indicated by an arrow K in FIG. 15). By doing so, the bulk density of the developer accommodated in the second removed developer accommodating portion 23 is increased. As a result, a large amount of the developer can be accommodated in the limited space.

(Structure for Driving Developer Feeding Means).

A description will be provided as to a driving structure for the developer feeding means.

Figure 16:
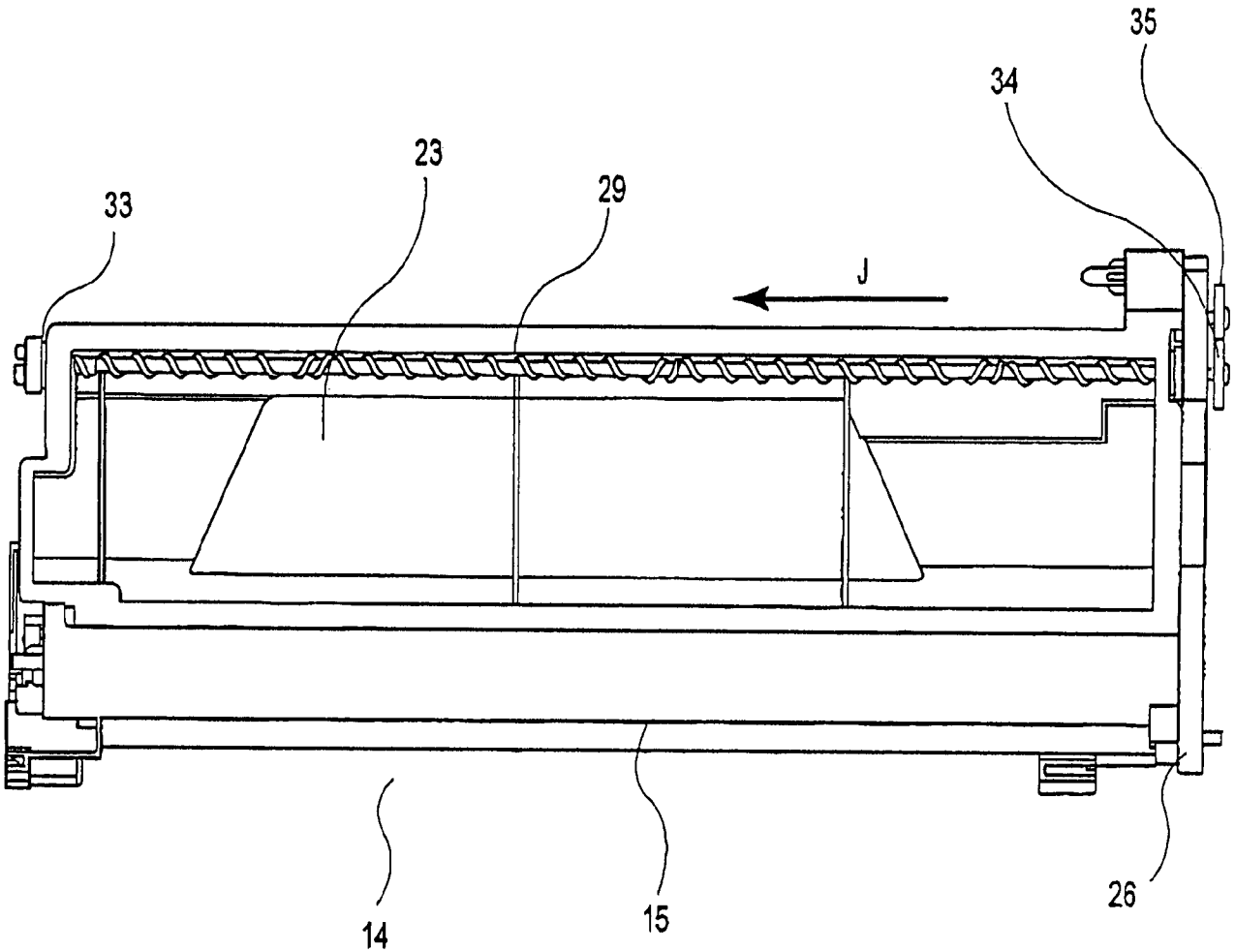
FIG. 16 is a front view showing a structure for driving a second screw according to an embodiment of the present invention.

As shown in FIG. 16, the second screw member 29 extends over the entire area of the removed developer accommodating portion 23 with respect to the longitudinal direction. One end of the second screw member 29 is connected with the feeding unit 26. The other end of the second screw member 29 is provided with an end coupling member 33 for receiving a driving force from the main assembly 99 of the apparatus 100.

Figure 17:
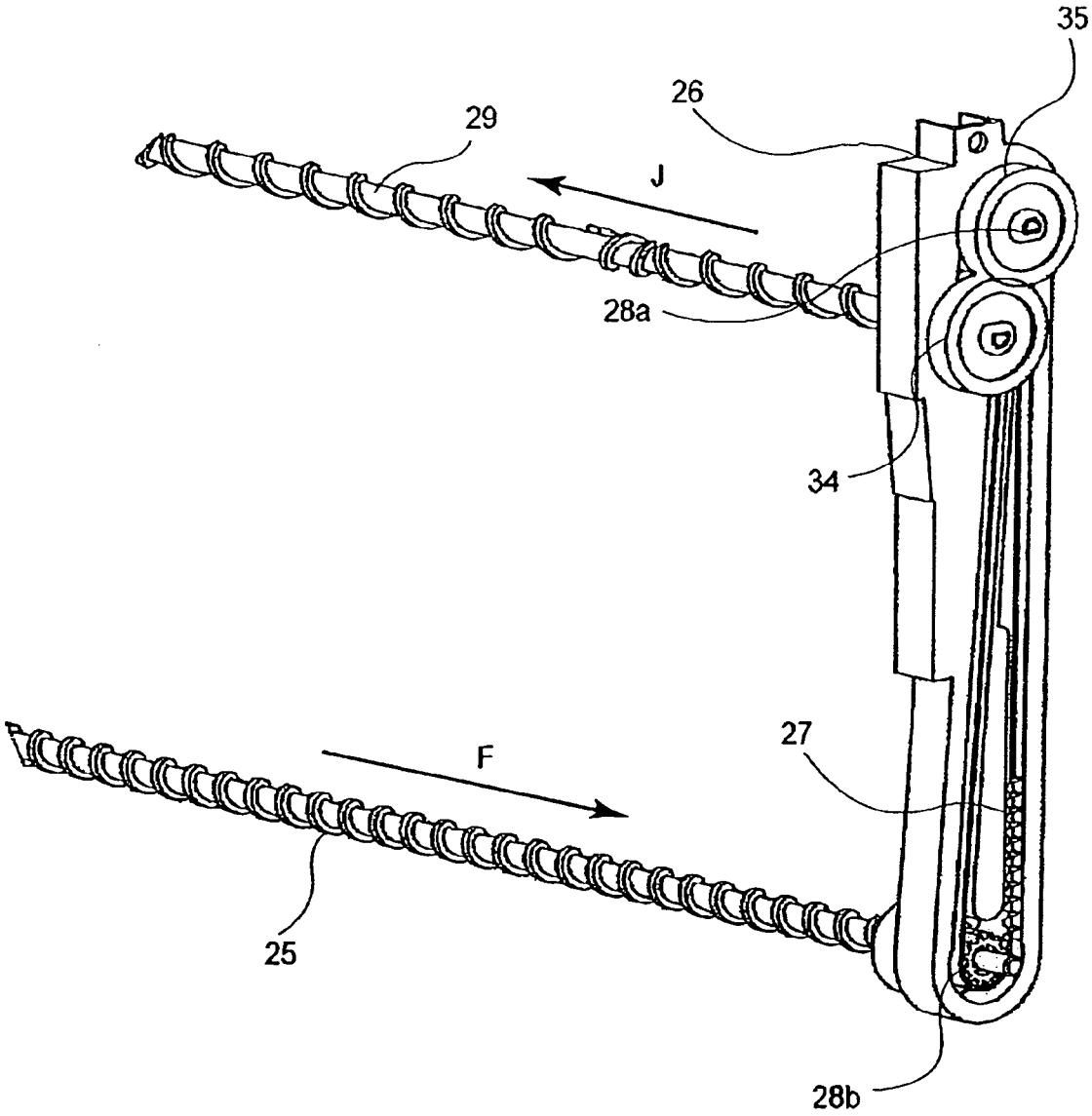
FIG. 17 is a perspective view showing a structure for driving the feeding unit according to an embodiment of the present invention.

Also, it is provided with a first idler gear 34 on such a side of second screw member 29 as is connected with the feeding unit 26. As shown in FIG. 17, the first idler gear 34 is in meshing engagement with the second idler gear 35, which is co-axially connected with the upper pulley member 28*a*, which in turn is in meshing engagement with the belt 27 of the feeding unit 26. On the other hand, the lower pulley member 28*b* is co-axially connection with the first screw member 25.

With this structure, the driving of the second screw member 29 having received the driving input from the main assembly 99 of the apparatus 100 is transmitted to the upper pulley member 28*a* through the first idler gear 34 and the second idler gear 35. By the rotation of the upper pulley member 28*a*, the belt 27 is rotated, and further, the lower pulley member 28*b* is rotated. By the rotation of the lower pulley member 28*b*, the first screw member 25 is rotated with such a structure, even in the case of a process cartridge 8 in which a plurality of developer feeding means are used in which the feeding directions are different, so that the developer can be fed efficiently by one driving input. In this manner, the removed developer accommodating portion is provided in the process cartridge 8, and the removed developer accommodating portion is efficiently disposed in a space around the process cartridge, and furthermore, the second removed developer accommodating portion 23 is provided with a feeding unit 26 for feeding the developer. Thus, downsizing and space saving are accomplished in a full-color image forming apparatus of a developer supplying type, wherein a plurality of process cartridges containing different color developers, respectively are arranged horizontally, using an intermediary transfer member. And, user operability of a process cartridge provided with a removed developer accommodation is improved.

EMBODIMENT 2

A second embodiment will be described. The basic structures of the device of this embodiment is the same as Embodiment 1, but only the structure of the second removed developer accommodating portion 23 of the process cartridge at the downstream side with respect to the image forming direction (the direction indicated by an arrow B in FIG. 7) is different.

Figure 7:
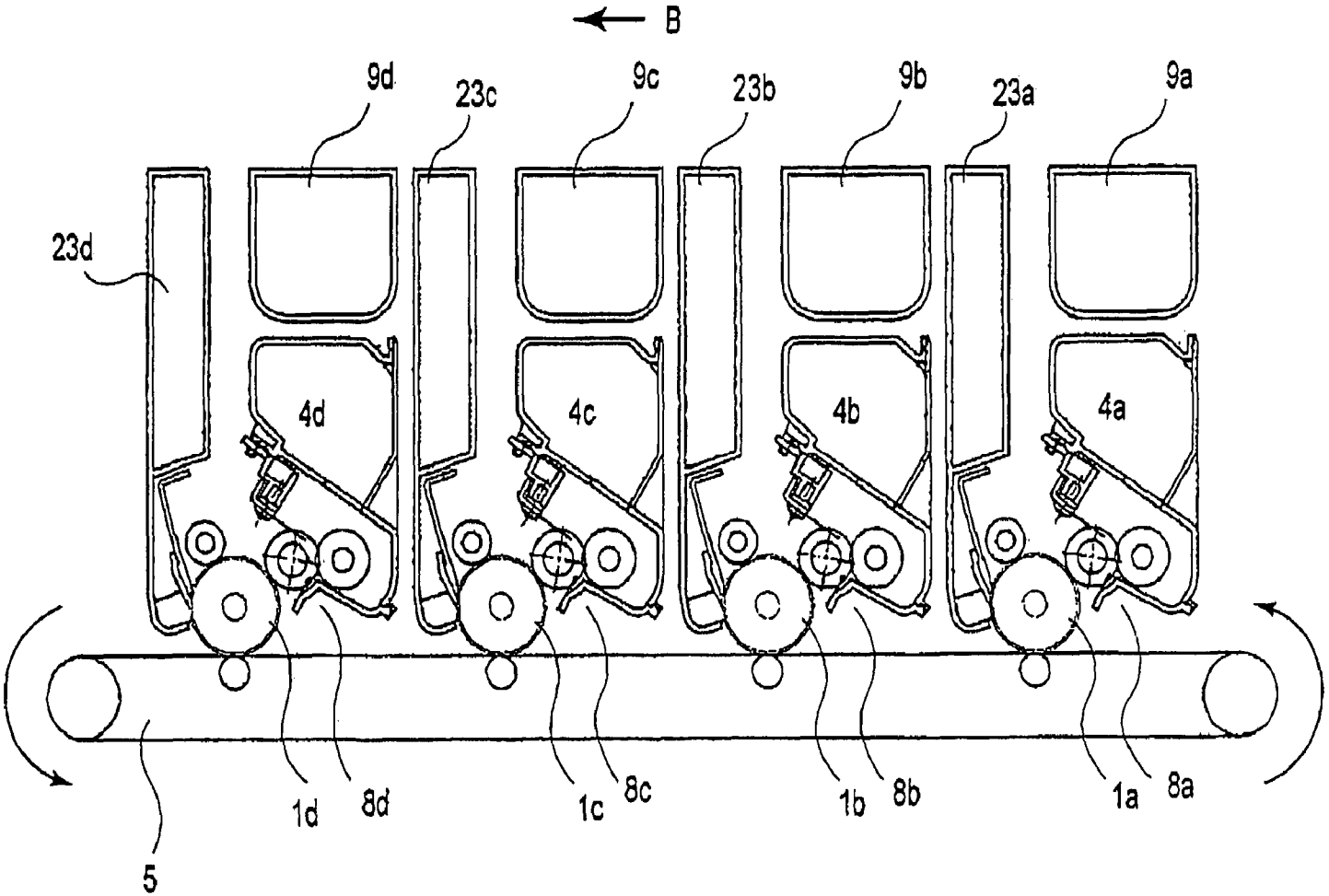
FIG. 7 is a side view illustrating a structure of an intermediary transfer belt.

First, referring to the FIG. 7 of Embodiment 1, a description will be provided as to the developer constituting fog on the intermediary transfer belt and as to a capacity of the removed developer collection portion.

As shown in FIG. 7, an intermediary transfer belt 5 is contacted to the surfaces of the photosensitive drums 1 of the process cartridges 8 arranged substantially horizontally along the image forming direction (the direction indicated by an arrow B in FIG. 7). The intermediary transfer belt 5 rotates in the direction of the arrow B. The developed images formed on the photosensitive drums 1 are transferred sequentially onto the intermediary transfer belt 5 from the upstream side of the image forming direction. At this time, the photosensitive drums 1 are supplied with different bias voltages. Therefore, the developed image transferred onto the intermediary transfer belt 5 at the upstream side is not transferred back onto the downstream photosensitive drum 1. However, a small amount of the developer (fog developer) is less influenced by the bias voltage applied to the photosensitive drum 1, and therefore, is transferred onto the surface of the photosensitive drum 1.

In view of this, a capacity of the second removed developer accommodating portion 23 of the process cartridge 8 is made larger toward the downstream with respect to the image forming direction. By this, the downstream side process cartridge 8 can accept in the second removed developer accommodating portion 23, the fog developer resulting from the upstream side process cartridge 8, as well as the developer removed from the associated process cartridge 8. Therefore, it can be avoided that second removed developer accommodating portion 23 of the downstream side process cartridge 8 becomes full earlier than the second removed developer accommodating portion 23 of the upstream side process cartridge 8.

Figure 18:
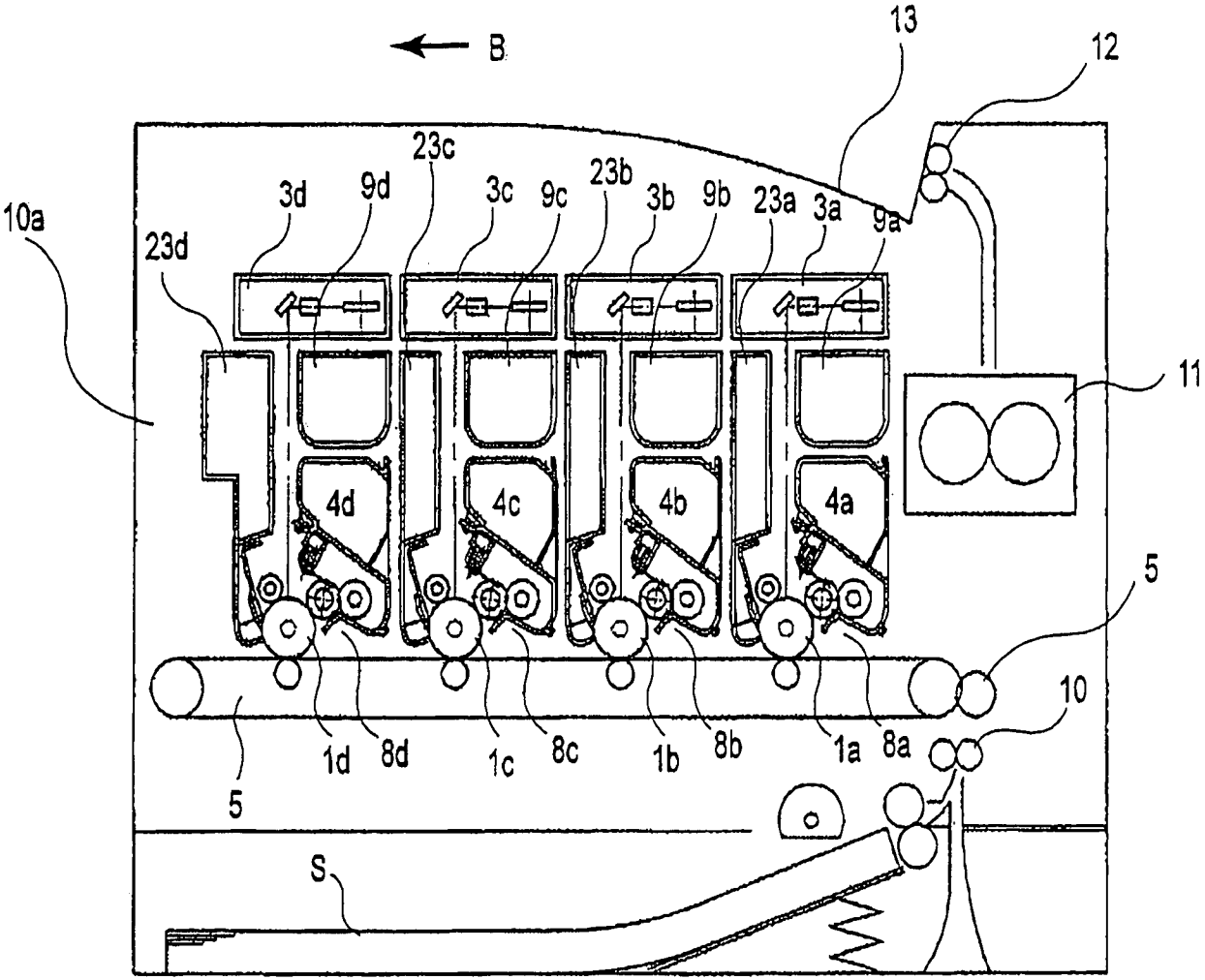
FIG. 18 is a side view illustrating a disposition of the removed developer collection portion.

This is shown in FIG. 18, wherein the capacity of the second removed developer accommodating portion 23*d* of the most downstream process cartridge 8*d* is larger in capacity. Thus, the problem with the fog developer can be solved without upsizing of the image forming apparatus 100.

As described in the foregoing, the second removed developer accommodating portion 23 is constituted by the cleaner container 15 and the covering member 24 connected with each other. In this embodiment, the cleaner container 15 of the process cartridge having the larger second removed developer accommodating portion 23 is the same as those of the other process cartridges 8, but the configuration of the covering member is made different to provide a larger capacity. By doing so, the capacity of the second removed developer accommodating portion 23 can be increased with minimum change in the configurations of parts.

This application claims priority from Japanese Patent Applications Nos. 360033/2004 and 073115/2005 filed Dec. 13, 2004 and Mar. 15, 2005, which is hereby incorporated by reference.

What is claimed is:

1. An electrophotographic image forming apparatus comprising:

i) a developer cartridge detachably mountable to a main assembly of said apparatus; and ii) a process cartridge detachably mountable to the main assembly of said apparatus, including:

an electrophotographic photosensitive drum;

a developing roller configured and positioned to develop an electrostatic latent image formed on said electrophotographic photosensitive drum;

a first developer accommodating portion configured and positioned to accommodate a developer to be used for development of the electrostatic latent image by said developing roller;

a developer receiving port configured and positioned to receive the developer from said developer cartridge into said first developer accommodating portion when said process cartridge is mounted to said image forming apparatus, wherein said developer receiving port faces upwardly when said process cartridge is mounted to said image forming apparatus;

a cleaning member configured and positioned to remove the developer from said electrophotographic photosensitive drum;

a first removed developer accommodating portion configured and positioned to accommodate the developer removed from said electrophotographic photosensitive drum by said cleaning member;

a second removed developer accommodating portion configured and positioned to accommodate the developer fed from said first removed developer accommodating portion, said second removed developer accommodating portion being disposed above said first removed developer accommodating portion when said process cartridge is mounted to said image forming apparatus, wherein said second removed developer accommodating portion is projected upwardly beyond said developer receiving port with respect to a vertical direction when said process cartridge is mounted to said image forming apparatus;

a developer feeder configured and positioned to feed the developer from said first removed developer accommodating portion to said second removed developer accommodating portion;

a developing unit; and a photosensitive drum unit, wherein said developer cartridge includes:

a second developer accommodating portion configured and positioned to accommodate the developer to be supplied to said process cartridge; and a developer supply port configured and positioned to supply the developer to said first developer accommodating portion through said developer receiving port, said developer supply port facing downwardly when said developer cartridge is mounted to said main assembly of the apparatus, and wherein when said process cartridge and said developer cartridge are mounted to said apparatus, said developer cartridge is disposed above said first developer accommodating portion and at a side of said second removed developer accommodating portion;

wherein said developing unit rotatably supports said developing roller, and contains said first developer accommodating portion and said developer receiving port, and wherein said photosensitive drum unit supports said electrophotographic photosensitive drum and said cleaning member, and contains said first removed developer accommodating portion, and said second removed developer accommodating portion.

2. An apparatus according to claim 1, wherein said developing unit extends in the longitudinal direction.

3. An apparatus according to claim 1, wherein said developing unit is disposed at one lateral side of said electrophotographic photosensitive drum when said process cartridge is mounted to the main assembly of said apparatus, and said developer receiving port is disposed above said developing unit when said process cartridge is mounted to the main assembly of said apparatus; and wherein said photosensitive drum unit is disposed at the other lateral side of said electrophotographic photosensitive drum when said process cartridge is mounted to the main assembly of the apparatus.

4. An apparatus according to claim 1 or 3, wherein a plurality of said process cartridges and said developer cartridges are disposed horizontally.

5. An apparatus according to claim 4, wherein said second removed developer accommodating portion that is most downstream, with respect to the feeding direction of the recording material, has an accommodation capacity layer than that of the other second removed developer accommodating portions.

6. A process cartridge usable with an electrophotographic image forming apparatus to which a process cartridge and a developer cartridge are independently mountable, the developer cartridge supplying developer to the process cartridge, said process cartridge comprising:

an electrophotographic photosensitive drum;

a developing roller configured and positioned to develop an electrostatic latent image formed on said electrophotographic photosensitive drum;

a first developer accommodating portion configured and positioned to accommodate a developer to be used for development of the electrostatic latent image by said developing roller;

a developer receiving port configured and positioned to receive the developer from the developer cartridge into said first developer accommodating portion when said process cartridge is mounted to the image forming apparatus, wherein said developer receiving port faces upwardly when said process cartridge is mounted to the image forming apparatus;

a cleaning member configured and positioned to removing the developer from said electrophotographic photosensitive drum;

a first removed developer accommodating portion configured and positioned to accommodate the developer removed from said electrophotographic photosensitive drum by said cleaning member;

a second removed developer accommodating portion configured and positioned to accommodate the developer fed from said first removed developer accommodating portion, said second removed developer accommodating portion being is disposed above said first removed developer accommodating portion when said process cartridge is mounted to the image forming apparatus, wherein said second removed developer accommodating portion is projected upwardly beyond said developer receiving port with respect to a vertical direction when said process cartridge is mounted to the image forming apparatus;

developer feeding means configured and positioned to feed the developer from said first removed developer accommodating portion to said second removed developer accommodating portion;

a developing unit; and a photosensitive drum unit, wherein said developing unit rotatably supports said developing roller, and contains said first developer accommodating portion and said developer receiving port, and wherein said photosensitive drum unit supports said electrophotographic photosensitive drum and said cleaning member, and contains said first removed developer accommodating portion, and said second removed developer accommodating portion.

7. A process cartridge according to claim 6, wherein said developing unit extends in the longitudinal direction of said electrophotographic photosensitive drum.

* * * * *

UNITED STATES PATENT AND TRADEMARK OFFICE

CERTIFICATE OF CORRECTION

PATENT NO. : 7,366,440 B2
APPLICATION NO. : 11/094371
DATED : April 29, 2008
INVENTOR(S) : Tadashi Horikawa It is certified that error appears in the above-identified patent and that said Letters Patent is hereby corrected as shown below:

COLUMN 4
Line 4, “that, is” should read --that is,--.
Line 7, “in” should read --is in--.

COLUMN 9
Line 21, “connection” should read --connected--.

COLUMN 10
Line 44, “is” should read --are--.

COLUMN 12
Line 4, “layer” should read --larger--.
Line 39, “is” should be deleted.

Signed and Sealed this

Third Day of February, 2009

John Doll

JOHN DOLL
*Acting Director of the United States Patent and Trademark Office*